US006843244B2

(12) United States Patent
McCalley et al.

(10) Patent No.: US 6,843,244 B2
(45) **Date of Patent: *Jan. 18, 2005**

(54) PORTABLE HEATER

(75) Inventors: Steve McCalley, Langhorne, PA (US); Sung Geun Lee, Chang Won (KR); Sung Boo Yoon, Bu San (KR)

(73) Assignee: Vermont Castings Majestic Products Company, Huntington, IN (US)

( * ) Notice: Subject to any disclaimer, the term of this patent is extended or adjusted under 35 U.S.C. 154(b) by 9 days.

This patent is subject to a terminal disclaimer.

(21) Appl. No.: 10/189,704

(22) Filed: Jul. 3, 2002

(65) Prior Publication Data

US 2003/0034026 A1 Feb. 20, 2003

Related U.S. Application Data

(63) Continuation-in-part of application No. 09/662,976, filed on Sep. 15, 2000, now Pat. No. 6,446,623.

(51) Int. Cl.[7] ..... F24C 15/00

(52) U.S. Cl. ..... 126/92 R; 431/344; 285/181; 285/272

(58) Field of Search ..... 126/92 R, 86, 126/92 AG, 92 B, 512; 431/344; 285/181, 272, 278, 280, 281; 119/310; 137/378, 382; 248/230.2, 231.31, 222.13

(56) References Cited

U.S. PATENT DOCUMENTS

| | | | | |
|---|---|---|---|---|
| 1,042,750 | A | | 10/1912 | Bader |
| 2,570,406 | A | | 10/1951 | Troshkin et al. |
| 2,574,625 | A | | 11/1951 | Coss |
| 2,861,562 | A | | 11/1958 | Ross et al. |
| 3,080,861 | A | | 3/1963 | Amero |
| 3,590,806 | A | | 7/1971 | Locke |
| 3,763,847 | A | | 10/1973 | Guzdar et al. |
| 3,813,207 | A | | 5/1974 | Ramey |
| 4,063,876 | A | | 12/1977 | Schweiss |
| 4,113,288 | A | | 9/1978 | Cox |
| 4,378,783 | A | | 4/1983 | Hunter |
| 4,687,235 | A | * | 8/1987 | Stoll ..... 285/281 |
| D319,305 | S | | 8/1991 | Beavers et al. |
| 5,052,432 | A | | 10/1991 | Vonalt et al. |
| 5,063,968 | A | | 11/1991 | Bartholomew |
| D325,963 | S | | 5/1992 | Anderson |
| 5,553,601 | A | | 9/1996 | Parker et al. |

(List continued on next page.)

FOREIGN PATENT DOCUMENTS

| | | |
|---|---|---|
| EP | 0 976 679 | 2/2000 |
| FR | 2764677 | 12/1998 |
| IT | 526841 | 5/1955 |
| JP | 7-286736 A | 10/1995 |
| JP | 9-196381 A | 9/1997 |

OTHER PUBLICATIONS

Solutions Brochure, "Outdoor Heater", Mar. 1999 p. 55 (2 pgs.).

(List continued on next page.)

*Primary Examiner*—Sara Clarke
(74) *Attorney, Agent, or Firm*—Sheridan Ross P.C.

(57) ABSTRACT

A portable heater comprises a housing, a heating element, and a fuel supply. The fuel supply is preferably a liquid gas type wherein a valve assembly meters the gas to the heating element. A regulator is used to regulate flow of gas from the fuel source, and a connector assembly rotatably interconnects the regulator to the valve assembly. This rotatable connection allows the fuel source, typically in the form of a gas bottle, to be rotated away from the housing for easier removal and replacement of the gas bottle. Rotation of the regulator can be supported by use of a bracket which is attached to the regulator.

40 Claims, 4 Drawing Sheets

U.S. PATENT DOCUMENTS

| | | | | |
|---|---|---|---|---|
| 5,553,893 | A | | 9/1996 | Foti |
| 5,738,084 | A | | 4/1998 | Hussong |
| 5,890,887 | A | | 4/1999 | Adler |
| 5,964,233 | A | | 10/1999 | Clark et al. |
| 5,979,432 | A | | 11/1999 | Grove |
| 6,065,468 | A | | 5/2000 | Willey et al. |
| 6,102,031 | A | | 8/2000 | Waters |
| 6,213,761 | B1 | | 4/2001 | Schmidt |
| 6,227,843 | B1 | * | 5/2001 | Pedersen et al. ..... 126/92 AC |
| 6,340,298 | B1 | | 1/2002 | Vandrak et al. |
| 6,397,835 | B1 | | 6/2002 | Liang |
| 6,446,623 | B1 | | 9/2002 | Resmo et al. |
| 6,447,017 | B1 | | 9/2002 | Gilbreath et al. |
| 6,619,281 | B2 | * | 9/2003 | Resmo et al. ..... 126/92 B |
| 2002/0089178 | A1 | * | 7/2002 | Resmo et al. ..... 285/181 |
| 2003/0136396 | A1 | * | 7/2003 | Resmo et al. ..... 126/92 R |

OTHER PUBLICATIONS http://raytech.simplenet.com/heaterssunglo.htm, "SUNGLO style heater", Dec. 20, 1999, Raytech, 3 pp.

http://www.easyradiantworks.com/sub/patio.eht, "Patio Plus Outdoor Heater", Easy Radiant Works, Dec. 20, 1999m 2 pp.

Improvements Catalog, "Firepole Space Heater", Mar. 3, 2000, 1 pg.

* cited by examiner

PORTABLE HEATER

CROSS REFERENCE OF RELATED APPLICATIONS

This application is a continuation-in-part of U.S. patent application Ser. No. 09/662,976 filed Sep. 15, 2000, now U.S. Pat. No. 6,446,623 entitled "MINIATURE PATIO HEATER" which is incorporated herein by reference.

FIELD OF THE INVENTION

This invention relates to portable heaters, and more particularly, to a portable heater including a rotatable connection to a fuel source for the heater, thereby enhancing the ability to use a portable fuel source in the heater.

BACKGROUND OF THE INVENTION

Space heaters have been used for many years to heat outdoor locations such as patios at restaurants, outdoor recreational facilities, garages, home patios, and other areas. Traditional space heater designs tended to be somewhat large and bulky, and were not particularly convenient for many home uses. Space heaters can take many forms to include patio heaters, bullet-type heaters, and many others.

Some examples of prior art gas heaters include the U.S. Pat. Nos. 6,065,468; 3,590,806; and 4,378,783. Although these heaters may be suitable for their intended purposes, one common disadvantage for each of these prior art heaters is the manner in which the fuel source is incorporated within the heater. Many of the prior art heaters do not have an easy and convenient system by which the fuel source can be replaced.

SUMMARY OF THE INVENTION

A portable heater is provided which can be transported easily from location to location, and integral means are provided for replacing the fuel source in a safe and efficient manner. The portable heater is fueled by a liquid propane bottle, or other known compressed gas sources. The fuel source is ignited in a conventional manifold or combustion chamber, which in turn heats a ceramic heating element which provides the source of heat. A safety system such as an oxygen depletion sensor system is provided to ensure safe operation of the portable heater. The liquid propane bottle is mounted on an end of the housing of the heater, and connects to a regulator, which in turn connects to a valve assembly. A control knob communicates with the valve assembly to control the flow of gas to the combustion chamber, as well as initiating the ignition for lighting the fuel, such as by spark ignition. A connector assembly interconnects the regulator to the valve assembly. The connector assembly allows the regulator to be rotated while the valve assembly and the associated gas lines remain stationary. Accordingly, if it is desired to replace the gas bottle, one simply rotates the gas bottle to an angular position for removal and replacement. After replacement of the gas bottle, the new gas bottle is simply rotated back to an upright position for storage within the portable heater. A removable side cover can be provided over the gas bottle to further secure the gas bottle within the housing.

The construction of the connector assembly can be of various forms. As shown in the preferred embodiment, the connector assembly includes an elbow connector, and a coupler or union. The elbow connector has an integral gas line which connects to the valve assembly. Preferably, one end of the coupler is threaded for attachment to the regulator, while the other end of the coupler is connected to the elbow connector and is adapted for rotational movement between it and the elbow connector. One or more seals are provided at the connection between the elbow and the end of the coupler to ensure no leakage of gas, yet still allowing the rotational movement between the two components. It is also contemplated within the scope of the invention that the connector assembly take other forms to accommodate the particular type of regulator used in the heater, as well as the particular type of fitting needed for connection to the valve assembly. For example, in lieu of a threaded connection at the regulator, a compression fitting could be used. Additionally, the elbow connector and the union or coupler could be prefabricated as a single unit wherein rotational movement is provided between two components or parts of the combined component.

Optionally, additional means can be provided to stabilize rotational movement of the regulator to ensure efficient removal of the gas bottle. As discussed below in the preferred embodiment, this additional structural support can take the form of a clamp which attaches to the regulator. The clamp can then be supported by the housing or some other support member attached to the housing. Preferably, the clamp attaches to an opposite side of the regulator as compared to the side of the regulator attached to the connector assembly. Thus, rotation of the regulator is maintained about a desired axis of rotation by supporting both sides of the regulator.

The particular arrangement of the rotatable regulator allows one to more easily replace the gas bottle. By allowing the gas bottle to be rotated away from the heater, one may grasp the base or end of the gas bottle, thus making it easier to unscrew the gas bottle from the regulator. Additionally, the height requirement for the opening in the housing is minimized because additional vertical space within the heater is unnecessary for attaching and detaching the gas bottle. The removable side cover in conjunction with the rotatable regulator also makes it easier to observe the regulator for damage or wear, and also facilitates easier cleaning of the regulator and its surrounding components.

Additional advantages of the invention will become more readily apparent from the description which follows, taken in conjunction with the accompanying drawings.

DETAILED DESCRIPTION OF THE DRAWINGS

Figure 1:
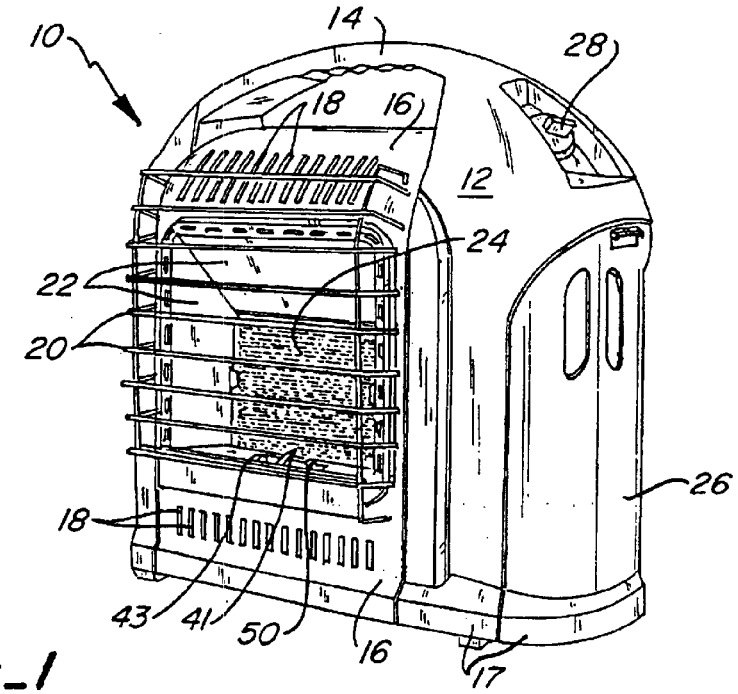
FIG. 1 is a perspective view of the portable heater of the invention.
Figure 2:
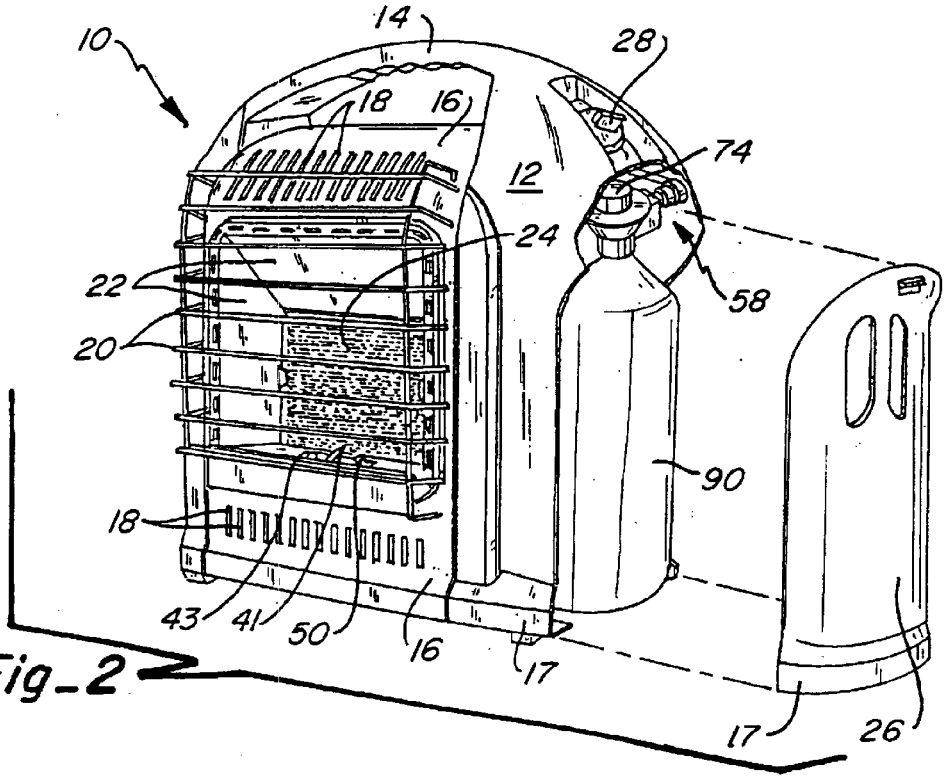
FIG. 2 is a fragmentary perspective view of the portable heater, illustrating the side cover removed exposing the gas bottle, and a portion of the housing broken away to view the regulator and connector assembly.

FIGS. 1 and 2 illustrate the portable heater 10 of the invention. The overall construction of the heater 10 includes a housing 12, and an integral carrying handle 14 which is formed as an upper portion of the housing 12. The housing 12 can be further defined as including a front panel 16 with a plurality of openings 18 formed therein to allow heat dissipation within the housing. The housing 12 may also be further defined as including a base 17 which supports the heater 10. The front face of the heater includes a safety grill 20 which prevents inadvertent access to a heat shroud 22, and a heating element 24. A ceramic heating element is but one type of well known heating element which may be used in the portable heater shown in FIG. 1. One end of the heater has a removable side cover 26 which may be removed to expose the gas bottle 90. An access opening can be defined as the space within the portable heater which allows insertion of the gas bottle therein. A control knob 28 is positioned on the housing 12 allowing the user to turn the heater on or off, and also to allow adjustable control for varying the amount of heat to be produced from the heater.

Figure 3:
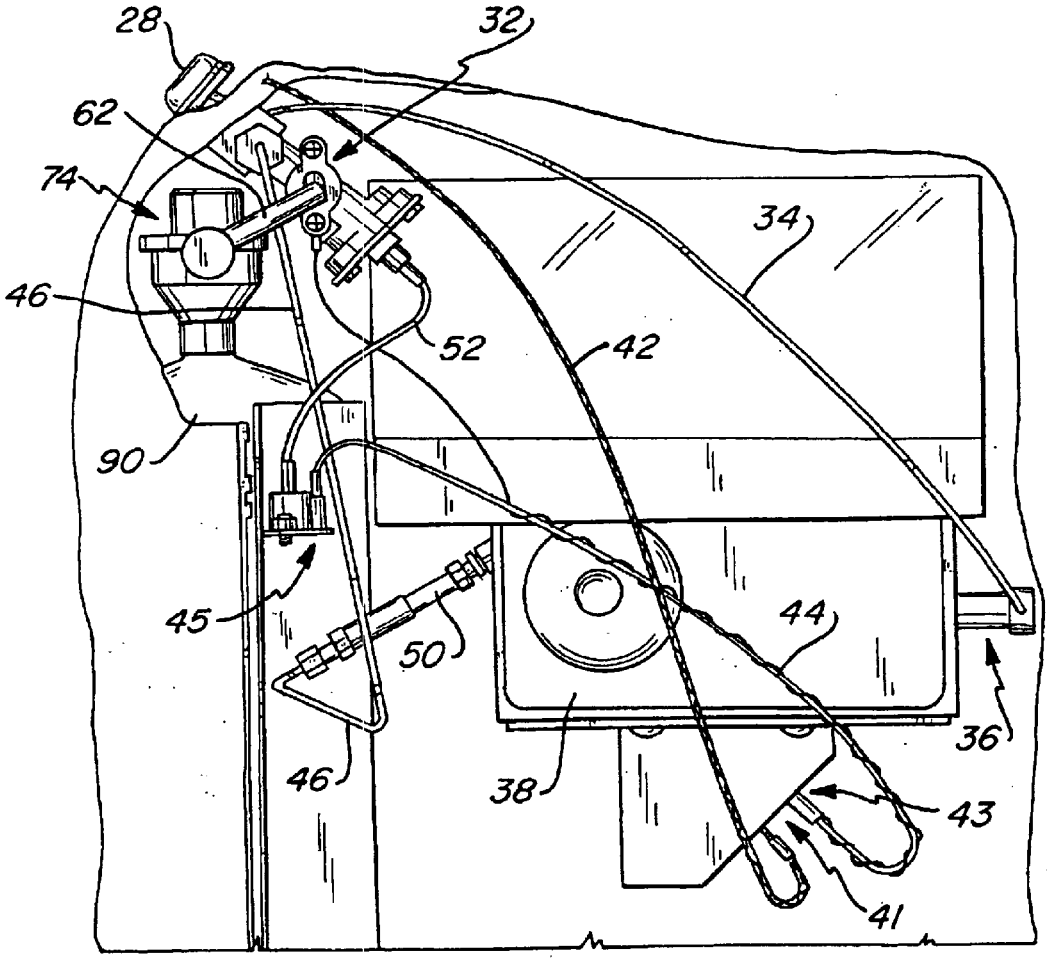
FIG. 3 is an enlarged fragmentary rear elevation view with the rear cover of the housing broken away to view the internal components of the portable heater, and particularly the mounting arrangement of the gas bottle, regulator, and valve assembly.

FIG. 3 illustrates some of the interior components of the heater. A valve assembly 32 is provided which controls the flow of gas to the heating element 24 based upon the operator's adjustment of control knob 28. When the operator turns the control knob 28 to the "on" position, gas is allowed to flow through gas line 34 which provides gas to a manifold/connector 36, and then gas travels to the combustion chamber 38 which is situated adjacent the heating element 24. Knob 28 also activates a spark ignition device 41 through spark ignition wire 42. Thus by turning the knob 28, it serves a dual purpose of ignition and gas flow control.

For safety purposes, the portable heater incorporates an oxygen depletion system to sense oxygen levels. The oxygen depletion system shuts off the flow of gas to the combustion chamber in the event of a low oxygen level. A sensor tip 43 is placed near the point of combustion. The sensor tip 43 connects to a sensor line 44 which is connected to a sensor switch/control unit 45. A low oxygen situation causes switch 45 to then close the valve assembly 32 through line 52. The sensor switch/control unit 45 may be in the form of a thermocouple, and the sensor tip 43 and sensor line 44 may be formed of heat conductive metal. The thermocouple generates an electrical current when heat is applied to the sensor tip 43. When oxygen levels drop below a specified level, the heat produced during combustion drops, reducing the electrical current produced by the thermocouple. The valve assembly 32 contains a solenoid valve (not shown) which is initially opened when the knob 28 is turned to the "on" position, and held open by the electrical current produced by the thermocouple. The solenoid is configured to close when the electrical current drops below a predetermined level which corresponds to a reduced oxygen level. The above described oxygen depletion system is just one of many common types of oxygen depletion systems which are available and are used on portable heaters. A separate gas line 46 may be provided for providing gas to the pilot 50 from the valve assembly 32.

Figure 6:
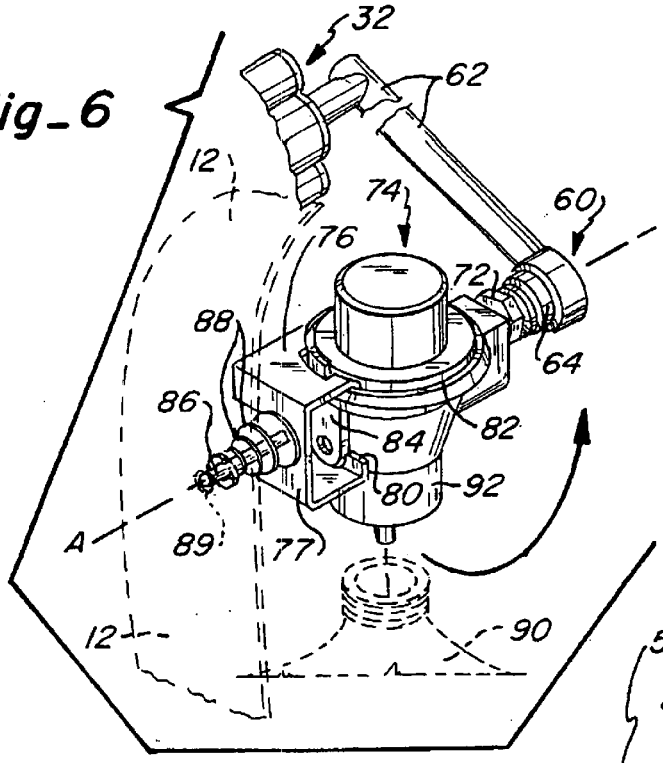
FIG. 6 is an enlarged fragmentary perspective view illustrating the regulator in the vertical position.
Figure 4:
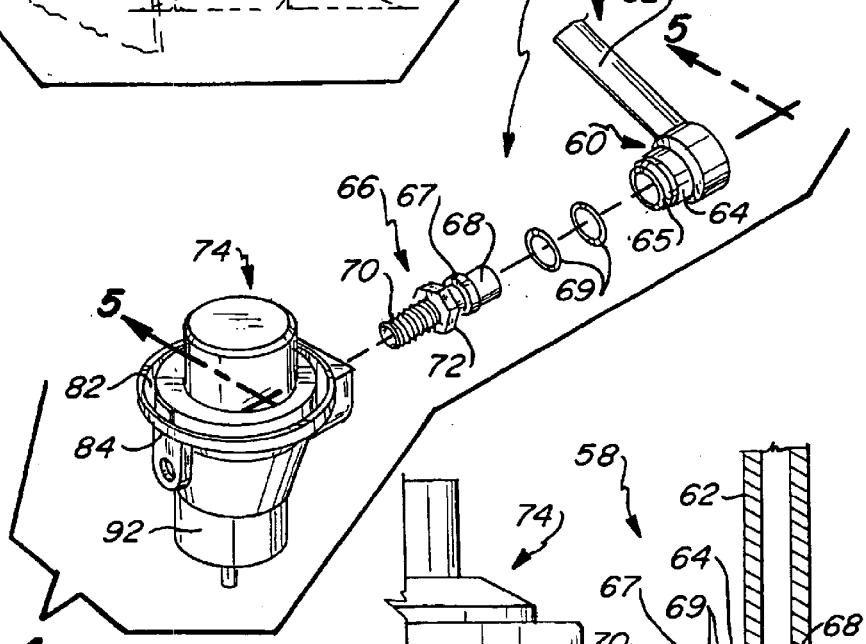
FIG. 4 is an enlarged exploded perspective view of the regulator and the connector assembly.
Figure 5:
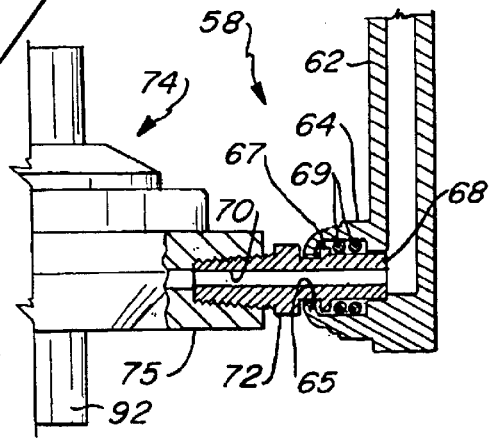
FIG. 5 is an enlarged fragmentary cross-sectional view of the regulator and connector assembly shown in FIG. 4.

Now referring to FIGS. 4–6, the particular construction of the connector assembly 58 is shown. The connector assembly comprises two major components, namely, the elbow connector 60 and the coupler or union 66. The elbow connector 60 comprises a gas tube 62 which allows gas to flow into the valve assembly 32. A coupler sleeve 64 extends transversely with respect to the gas tube 62. The coupler sleeve includes a smaller distal or free end 65. The coupler or union 66 has one end 68 which is adapted to receive one or more seals 69. This end also has an intermediate flange 67 which helps to secure the coupler when attached to elbow connector 60. The opposite end 70 of the coupler is threaded which allows it to be screwed into port 75 formed on the regulator 74. An integral nut 72 may be positioned between the ends 68 and 70 thus facilitating attachment of the coupler to the regulator 74.

As shown in FIG. 5, one end of the coupler 66 is screwed into the port 75. The opposite end of the coupler is received within the coupler sleeve 64, and the seals 69, such as o-rings, provide a leak proof connection between the elbow 60 and the coupler 66. The smaller end 65 of the coupler sleeve 64 may be crimped or otherwise enclosed around the flange 67 of the coupler 66, thereby trapping the seals 69 within the coupler sleeve 64. The arrangement of the coupler 66 and the elbow 60 allows relative movement between the two elements, thereby allowing the regulator to be rotated when the elbow 60 is fixed.

Although a specific construction is shown for the connector assembly 58, other arrangements can be provided depending upon the type of regulator used, as well as the type of connection necessary for the valve assembly. Despite the orientation or location of the regulator with respect to a gas line interconnecting the regulator to a valve assembly, the invention herein contemplates some means to provide rotation of the regulator so that the gas bottle may be more easily manipulated for removal or replacement.

Referring now to FIG. 6, in order to further stabilize the rotational capability of the regulator 74, a stabilizer bracket or clamp 76 may be attached to the regulator 74. As shown in the Figure, the bracket 76 supports an opposite side or end of the regulator as compared to the end of the regulator which attaches to the connector assembly 58. The stabilizer bracket 76 may be in the form of a c-shaped bracket or clamp having an upper jaw 78 which frictionally engages an upper end 82 of the regulator 74, and a lower jaw 80 which frictionally engages a flange 84 or some other protruding structure formed on the regulator 74. A rod or pin 86 is spring loaded as by spring 88, the rod 86 and spring 88 attaching to the vertical face 77 of the bracket 76. The free end of rod 86 protrudes through a small opening 89 formed in the housing 12. Thus, rotational movement of the regulator 74 along axis A—A is stabilized by use of the bracket 76.

FIG. 6 illustrates the regulator in the vertical position as when a gas bottle 90 is attached to the regulator for use.

Figure 7:
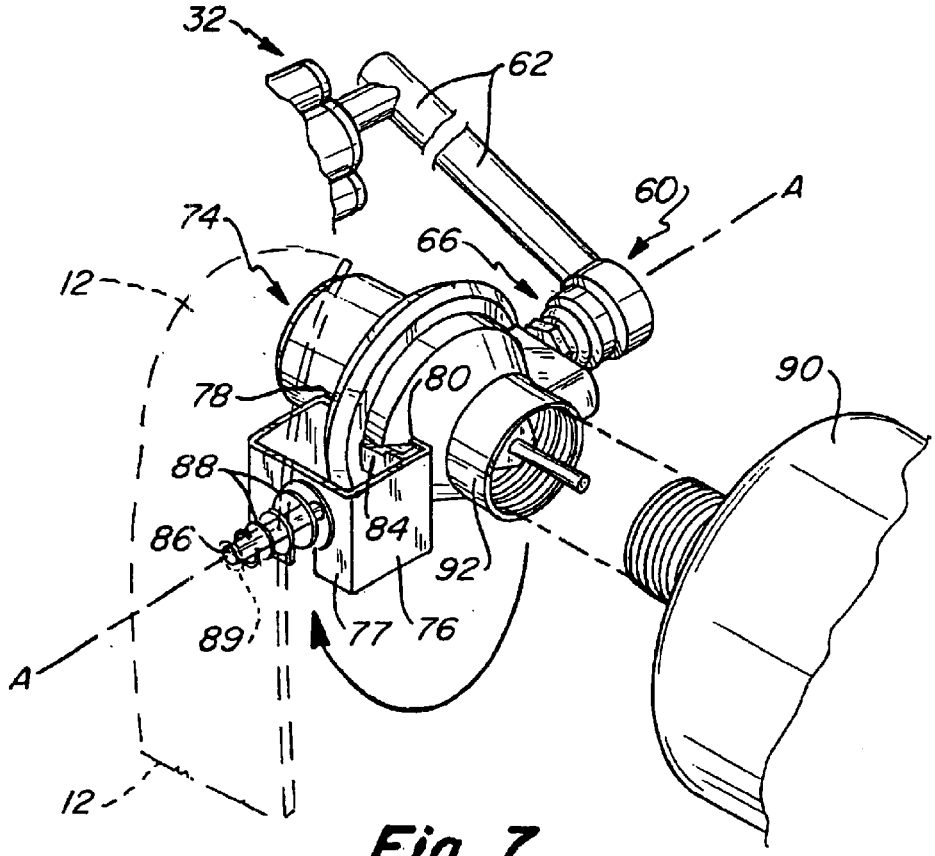
FIG. 7 is another enlarged fragmentary perspective view, but showing the regulator rotated to an angular position so that the gas bottle can be removed or replaced.

FIG. 7 illustrates the regulator 74 being rotated so that the gas bottle 90 may be removed and replaced. As shown, the regulator maintains its rotation about axis A—A, and is further stabilized by use of the stabilizer bracket 76.

To replace an empty gas bottle, side cover 26 is removed from the housing 12 for gaining access to the gas bottle. The gas bottle 90 is grasped and rotated upwards from the vertical upright position to the angular position shown in FIG. 7. The empty gas bottle is then unscrewed from a threaded coupler 92 of the regulator. A full gas bottle may then be reattached to the regulator 74, and the full gas bottle is then rotated back to the vertical position. Finally, the side cover 26 is replaced.

There are a number of advantages to the provision of the connector assembly which allows rotation of the regulator. In the first place, the access opening within the chamber 12 which houses the gas bottle may be made smaller/shorter than would otherwise be possible to replace the gas bottle 90 since no extra vertical space or height is required for detaching the gas bottle. Additionally, the access opening formed in the housing only needs to be large enough to accommodate side entry of the gas bottle as opposed to also providing an access opening through the base or bottom of the housing. Therefore, the structural integrity of the housing is better maintained by provision of a smaller access opening. In terms of safety and ease of use, allowing rotation of the gas bottle away from the heater allows one to better grasp the gas bottle for removal or replacement, and also helps to prevent inadvertent cross-threading of the gas bottle with the threads of the coupler 92.

This invention has been described in detail with reference to a particular embodiment thereof, but it will be understood that various other modifications can be affected within the spirit and scope of the invention.

What is claimed is:

1. A portable heater comprising:

a housing;

a heating element mounted in said housing for producing heat;

a valve assembly communicating with said heating element for controlling the flow of a fuel to said heating element;

a regulator;

a gas bottle removably attached to said regulator; and a connector assembly rotatably interconnecting said regulator and said valve assembly so that the gas bottle may be selectively rotated from a first use position to a second angular position for removal and replacement of the gas bottle.

2. The heater, as claimed in claim 1, wherein the connector assembly includes:

a first coupling element having a first end communicating with said valve assembly, and said first coupling element further having a second end; and a second coupling element having a first end communicating with said regulator, and said second coupling element having a second end which connects to said second end of said first coupling element, wherein said second coupling element is rotatable with respect to said first coupling element thereby allowing rotation of the regulator along with the gas bottle connected to the regulator.

3. A heater, as claimed in claim 2, wherein:

said first coupling element is in the form of an elbow, and said second coupling element is in the form of a union.

4. A heater, as claimed in claim 2, wherein:

said first coupling element is in the form of an elbow, and said second end thereof includes a crimped portion for engagement with said second end of said second coupling element; and said second coupling element is in the form of a union, said first end thereof having threads for connection to said regulator.

5. A heater, as claimed in claim 2, further including:

at least one seal placed between said second end of said first coupling element and said second end of said second coupling element.

6. A heater, as claimed in claim 5, wherein:

said seal is in the form of an o-ring.

7. A heater, as claimed in claim 1, further including:

a stabilizing bracket attached to said regulator thereby stabilizing said regulator for rotation about a fixed axis of rotation.

8. A heater, as claimed in claim 7, wherein:

said stabilizing bracket attaches to one side of said regulator, and said connector assembly connects to a substantially opposite side of said regulator.

9. A heater, as claimed in claim 7, wherein:

said stabilizing bracket includes upper and lower jaws engaging said regulator, and a spring loaded rod connected between said upper and lower jaws, and attaching to said housing.

10. A heater, as claimed in claim 1, further including:

a removable cover placed over said gas bottle when said gas bottle is installed within said heater.

11. A heater, as claimed in claim 1, wherein:

said first use position is substantially vertical and said second angular position is angled away from substantially vertical.

12. A portable heater comprising:

a housing;

a heating element mounted in the housing for providing heat;

a valve assembly communicating with the heating element for controlling fuel to the heating element;

a regulator communicating with the valve assembly;

a gas bottle mounted to the regulator; and means for rotatably interconnecting the regulator and the valve assembly enabling the gas bottle to be selectively rotated between a first use position and a second angular position whereby the gas bottle may be removed and replaced.

13. A heater, as claimed in claim 12, wherein the means for rotatably interconnecting includes:

a first coupling element having a first end communicating with the valve assembly, and said first coupling element having a second end; and a second coupling element having a first end communicating with the regulator, and said second coupling element having a second end which connects to said second end of said first coupling element, wherein said second coupling element is rotatable with respect to said first coupling element thereby allowing rotation of the regulator along with the gas bottle connected to the regulator.

14. A heater, as claimed in claim 13, wherein:

said first coupling element is in the form of an elbow, and said second coupling element is in the form of a union.

15. A heater, as claimed in claim 13, wherein:

said first coupling element is in the form of an elbow, and said second end thereof includes a crimped portion for engagement with said second end of said second coupling element; and said second coupling element is in the form of a union, said first end thereof having threads for connection to the regulator.

16. A heater, as claimed in claim 13, further including:

at least one seal placed between said second end of said first coupling element and said second end of said second coupling element.

17. A heater, as claimed in claim 16, wherein:

said seal is in the form of an o-ring.

18. A heater, as claimed in claim 12, further including:

a stabilizing bracket attached to the regulator thereby stabilizing the regulator for rotation about a fixed axis of rotation.

19. A heater, as claimed in claim 18, wherein:

said stabilizing bracket attaches to one side of the regulator, and said means for rotatably interconnecting connects to a substantially opposite side of the regulator.

20. A heater, as claimed in claim 18, wherein:

said support bracket includes upper and lower jaws engaging the regulator, and a spring loaded rod connected between said upper and lower jaws, and attaching to the housing.

21. A heater, as claimed in claim 12, further including:

a removable cover placed over the gas bottle when the gas bottle is installed within said heater.

22. A portable heater comprising:

a housing;

a heating element mounted in the housing for providing heat;

a valve assembly communicating with the heating element for controlling fuel to the heating element;

a regulator communicating with the valve assembly;

a gas bottle mounted to the regulator; and a connector assembly interconnecting the regulator and the valve assembly enabling the gas bottle to be selectively rotated between a first use position and a second angular position for removal and replacement of the gas bottle.

23. The heater, as claimed in claim 22, wherein the connector assembly includes:

a first coupling element having a first end communicating with the valve assembly, and said first coupling element having a second end; and a second coupling element having a first end communicating with the regulator, and said second coupling element having a second end which connects to said second end of said first coupling element, wherein said second coupling element is rotatable with respect to said first coupling element thereby allowing rotation of the regulator along with the gas bottle connected to the regulator.

24. A heater, as claimed in claim 23, wherein:

said first coupling element is in the form of an elbow, and said second coupling element is in the form of a union.

25. A heater, as claimed in claim 23, wherein:

said first coupling element is in the form of an elbow, and said second end thereof includes a crimped portion for engagement with said second end of said second coupling element; and said second coupling element is in the form of a union, said first end thereof having threads for connection to the regulator.

26. A heater, as claimed in claim 23, further including:

at least one seal placed between said second end of said first coupling element and said second end of said second coupling element.

27. A heater, as claimed in claim 26, wherein:

said seal is in the form of an o-ring.

28. A heater, as claimed in claim 22, further including:

a stabilizing bracket attached to the regulator thereby stabilizing the regulator for rotation about a fixed axis of rotation.

29. A heater, as claimed in claim 28, wherein:

said stabilizing bracket attaches to one side of the regulator, and said connector assembly connects to a substantially opposite side of the regulator.

30. A heater, as claimed in claim 28, wherein:

said stabilizing bracket includes upper and lower jaws engaging the regulator, and a spring loaded rod connected between said upper and lower jaws, and attaching to the housing.

31. A heater, as claimed in claim 22, further including:

a removable cover placed over the gas bottle when the gas bottle is installed within said heater.

32. A heater, as claimed in claim 22, wherein:

said first use position is substantially vertical and said second angular position is angled away from substantially vertical.

33. A method of changing a fuel bottle housed in a portable heater having a carrying handle and an integral heating element, said method comprising the steps of:

providing a first fuel bottle connected to a regulator of the heater;

rotating the first fuel bottle and the regulator from a first use position to a second angular position away from the first use position, so that the first fuel bottle extends away from the heater;

detaching the first fuel bottle from the regulator;

attaching a second fuel bottle to the regulator; and rotating the second fuel bottle and the regulator from the second angular position back to the first use position.

34. A method as claimed in claim 33, including the further steps of:

removing a removable cover from the heater to access the first fuel bottle prior to said step of rotating the first fuel bottle and the regulator from the first use position to the second angular position; and replacing the removable cover after said step of rotating the second fuel bottle and the regulator from the second angular position back to the first use position.

35. A method as claimed 33, including the step of:

providing a stabilizing bracket attached to the regulator for supporting the regulator during said rotating steps.

36. A method as claimed in claim 35, wherein:

said rotating steps further comprises the step of rotating the regulator and the stabilizing bracket about an axis.

37. A method as claimed in claim 33, further comprising the step of:

providing a connector assembly between the regulator and a valve assembly, the connector assembly enabling the first fuel bottle and the regulator to be selectively rotated between the first use position and the second angular position.

38. A method as claimed in claim 37, wherein:

the connector assembly includes:

a first coupling element having a first end communicating with the valve assembly, and said first coupling element having a second end; and a second coupling element having a first end communicating with the regulator, and said second coupling element having a second end which connects to said second end of said first coupling element, wherein said second coupling element is rotatable with respect to said first coupling element thereby allowing rotation of the regulator along with the first or the second fuel bottle connected to the regulator.

39. A method as claimed in claim 38, wherein:

the first coupling element remains substantially immobile during said rotating steps.

40. A method as claimed in claim 38, wherein:

said rotating steps further comprise the step of rotating the regulator and the second coupling element about an axis.

* * * * *